United States Patent [19]

Holt

[11] 4,367,821

[45] Jan. 11, 1983

[54] PAINT PAIL WITH DEPENDING SKIRT FOR LABEL ATTACHMENT

[75] Inventor: William G. Holt, Raynham, Mass.

[73] Assignee: Hercules Incorporated, Wilmington, Del.

[21] Appl. No.: 186,875

[22] Filed: Sep. 12, 1980

[51] Int. Cl.[3] ..... B65D 1/12

[52] U.S. Cl. ..... 220/72; 220/74; 220/91; 215/31

[58] Field of Search ..... 220/72, 74, 91, 306, 220/94 A; 215/1 C, 31, 100 A; 150/0.5; 40/306, 310

[56] References Cited

U.S. PATENT DOCUMENTS

| | | | |
|---|---|---|---|
| 1,938,353 | 12/1933 | Rollason | 220/74 X |
| 2,656,066 | 10/1953 | Riemenschneider | 220/72 X |
| 3,148,797 | 9/1964 | Cloyd | 220/72 X |
| 3,191,225 | 10/1962 | Polka | 18/5 |
| 3,194,857 | 6/1962 | White | 264/94 |
| 3,207,822 | 8/1962 | Makowski | 264/94 |
| 3,529,743 | 9/1970 | Ehrbar et al. | 220/74 |
| 3,621,529 | 12/1969 | Kovacs | 18/5 |
| 3,788,829 | 11/1968 | Miner et al. | 65/79 |
| 3,804,289 | 4/1974 | Churan | 220/72 X |
| 3,977,563 | 6/1975 | Holt | 220/206 |
| 3,999,677 | 12/1976 | Oberkircher | 220/74 X |
| 4,065,536 | 12/1977 | Lucas | 215/1 C X |
| 4,076,484 | 2/1978 | Armour et al. | 425/525 |
| 4,086,315 | 8/1976 | Piotrowski | 264/97 |
| 4,181,226 | 1/1980 | Weinert | 220/91 X |
| 4,215,789 | 8/1980 | Pfeifer | 220/91 X |
| 4,228,911 | 10/1980 | Hammes | 220/74 X |
| 4,240,554 | 8/1979 | Bock | 220/72 X |
| 4,280,859 | 7/1981 | Thompson | 215/1 C X |

FOREIGN PATENT DOCUMENTS

| | | | |
|---|---|---|---|
| 474542 | 6/1951 | Canada | 215/1 C |
| 340877 | 1/1931 | United Kingdom | 220/74 |

*Primary Examiner*—William Price
*Assistant Examiner*—Gary E. Elkins
*Attorney, Agent, or Firm*—Robert C. Beam

[57] ABSTRACT

A container is disclosed which has an injection molded annular mouth portion with detail of high definition, a generally cylindrical body portion blow molded from a parison integrally injection molded with the mouth portion, said body portion having an inside diameter slightly larger than the inside diameter of the mouth portion, and an annular reinforcing region joining the mouth portion to the body portion and forming a transitional surface therebetween, in which the detail of high definition in the mouth portion includes a depending skirt which serves as an outside wall over said reinforcing region providing a suitable label attachment area over the reinforcing region. Also disclosed are embodiments in which interior reinforcing ribs may be formed integrally with the depending skirt, or in which the bale ears are formed at the lower periphery of the depending skirt. Protrusions on the injection molded ribs or bale ears may be used to lock the skirt or bale ear into the body portion for added strength.

6 Claims, 8 Drawing Figures

PAINT PAIL WITH DEPENDING SKIRT FOR LABEL ATTACHMENT

SUMMARY OF THE INVENTION

The present invention relates to a container formed by blow molding the parison portion of an injection molded preform. Specifically, the present invention relates to a container in which there is provided as an element of high definitional detail injection molded into the preform a depending skirt which serves as an outside wall to provide a label attachment area over the transitional surface formed, in blow molding, between the injection molded detail area and blown parison portion. Also provided as elements of the high definitional detail which may be injection molded into the preform are interior reinforcing ribs or lowered bale ears which are formed at the lower periphery of the depending skirt. In addition, protrusions on the injection molded ribs or bale ears may be used to lock the skirt or bale ear into the body portion for added strength.

BACKGROUND OF THE INVENTION

Injection blow molding machines, such as disclosed in U.S. Pat. No. 4,076,484 having the same assignee as the present invention, are well known in the art for forming hollow articles, particularly containers of various sizes and shapes. Thermoplastic materials such as polypropylene or polyethylene are heated to a molten, semi-fluid state and are injected into the cavity of an injection mold to form a parison over a removable core or parison pin. Before the material has had an opportunity to completely set, the parison thereon is removed from the injection mold and transferred to a blow mold where pressurized gas or air is blown through the pin to the interior of the parison and causes the parison to expand outwardly in the larger cavity of the blow mold. The expanded parison takes the shape of the blow mold cavity corresponding to a desired shape of the article, and is allowed to set sufficiently to retain that shape thereafter.

In containers of the kind envisioned in the present invention, a highly detailed mouth area is injection molded integrally with a parison portion. The parison portion is then blow molded to the dimensions of the body portion of the finished container. In doing so, a transitional surface is formed between the injected molded mouth area and the larger diameter body portion, which appears as an annular groove on the outside surface of the container just below the mouth area. A container of this kind is illustrated in FIG. 1 of my U.S. Pat. No. 3,977,563.

This groove is not a structural defect from the standpoint of the container's integrity although the groove does decrease the container's stackability slightly. It does, however, represent an irregularity from the standpoint of using the container interchangeably with conventional metal containers in mechanical filling, labeling and packaging equipment. Thus, if the container is designed to specifications which allow it to be filled and packaged interchangeably with conventional containers, the labeling area available on the body portion is substantially smaller than the labeling area of conventional containers. This prevents the application of labels to the containers on existing machinery without substantial modification of those machines to accommodate the differently sized labels.

In addition, in order to provide integral and therefore stronger bale ears for the attachment of a handle to the container, the prior art required that such bale ears must be provided very near the top of the container since these features were required to be provided by injection molding in order to have sufficient detail. In so doing, the containers could not readily be prepared on automatic bale equipment, and were additionally incompatible for this reason.

It is an object of the present invention to provide a container which has a labeling area sufficient for use of the container on conventional labeling machinery without substantial modification of the machinery.

It is a further object of the present invention to provide a container which may be used interchangeably with conventional containers on filling, labeling and packaging machinery.

It is a still further object of the present invention to provide a container with increased wall strength in the region of the transitional surface between the injection molded preform and the blown parison.

It is still further object of the present invention to provide a container in which integrally injection molded bale ears may be provided in the region which would make the container interchangeable with conventional containers on automatic bale equipment.

The object, features, and advantages of the present invention will become more apparent in light of the following detailed description of the preferred embodiment thereof and as illustrated in the accompanying drawings.

According to the present invention, there is provided a container comprising: an injection molded annular mouth portion having detail of high definition, a generally cylindrical body portion blow molded from a parison integrally injection molded with the mouth portion, said body portion having an inside diameter slightly larger than the inside diameter of the mouth portion, and an annular reinforcing region joining the mouth portion to the body portion and forming a transitional surface therebetween, in which the detail of high definition in the mouth portion includes a depending skirt which serves as an outside wall over said reinforcing region providing a suitable sidewall label attachment area over the reinforcing region.

DETAILED DESCRIPTION OF THE DRAWINGS

Figure 1:
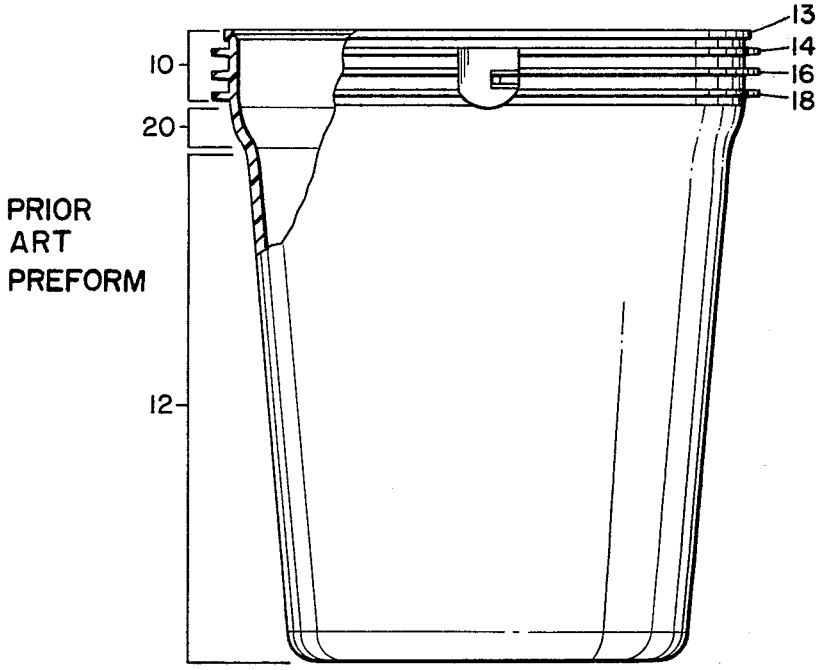
FIG. 1 shows a partially broken away view of the preform used to form the container of the prior art.

In FIG. 1, a partially broken away view of the preform used to form the container of the prior art is shown. This preform is prepared by injection molding a suitable thermoplastic material, such as polyethylene or polypropylene. The preform comprises two general areas: a mouth portion (10) and a parison portion (12). The mouth portion contains detail such as the sealing lip (13) and the ribs (14), (16) and (18) which are all meant to remain as features in the completed container. The parison portion (12) is intended to be expanded by internal pressure to the dimensions of the finished container in a blow molding step.

Between these two general areas there is a reinforcing region, shown as (20) in FIG. 1. This region acts as a transitional surface between the injection molded mouth portion (10) and the parison portion (12). In the preform shown in FIG. 1, this reinforcing region (20) has a generally decreasing inside diameter from the mouth portion (10) to the parison portion (12).

Figure 2:
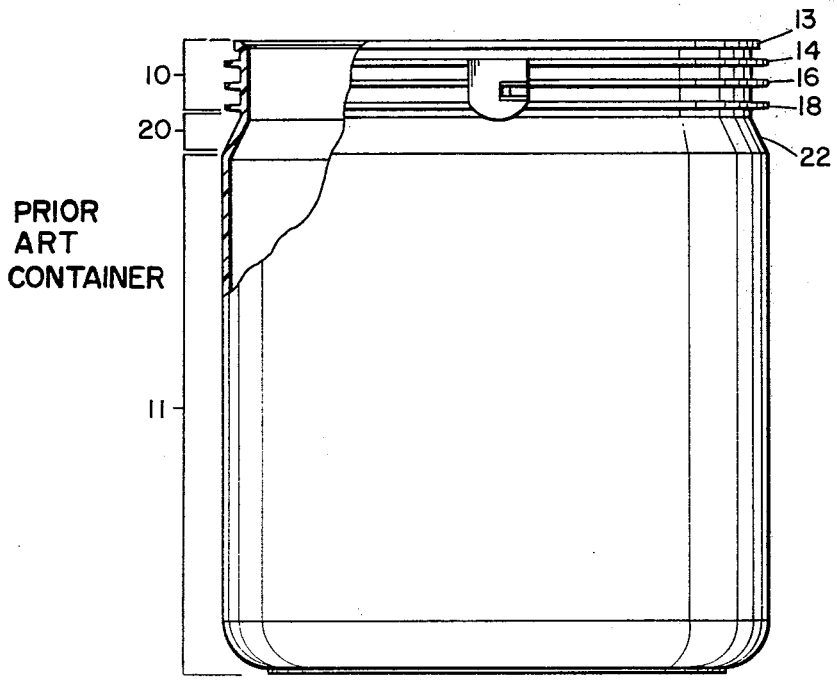
FIG. 2 shows a partially broken away view of the completed container of the prior art.

When the parison portion (12) is subjected to increased internal pressure during blow molding, the thermoplastic material of the parison portion (12) expands to fill the blow molding cavity, which has the dimensions of the finished container. This results in the container of the prior art, which is shown in a partially broken away view in FIG. 2. In this drawing, the injection molded mouth portion (10) retains its shape and is still provided with the sealing lip (13) and the detail ribs, shown as (14), (16), and (18). However, the body portion (11) of the container in FIG. 2 has been formed from the parison portion, shown as (12) in FIG. 1. The body portion (11) when thus formed, has an inside diameter which is larger than the inside diameter of the mouth portion (10). Thus, in the completed container of the prior art, the reinforcing region (20) must provide a transitional surface of gradually increasing diameter between the mouth portion (10) and the body portion (11).

The effect of this is to create an annular groove or notch (22) around the outside surface of the finished container of the prior art. This groove does not limit the integrity of the container in any way, although the groove does decrease the container's stackability slightly. However, when the design characteristics of the container are intended to make it interchangeable with conventional metal containers on filling machinery, the groove limits the area available for labeling, and such containers cannot be used interchangeably on labeling machinery. In fact, special sized labels must be used and this requires additional production time to hand affix such labels or modify the labeling machinery lines to accommodate them.

It has now been found that this difficulty may be overcome by providing additional detail to the mouth portion of a container during the injection molding step. The preform used to form the container of the present invention is shown in a partially broken away view in FIG. 3. In this preform, an injection molded mouth portion (30) and parison portion (32) joined by a reinforcing region (40) are all formed from a suitable thermoplastic.

The injection molded mouth portion (30) of the present invention is provided with detail similar to the prior art. However, in addition to the sealing lip (34) and the rib (36) which are substantially identical to the sealing lip (13) and the rib (14) in FIG. 1, the second rib (38) is provided with a depending segment or skirt (39) which extends for part or all of the reinforcing region (40) and surrounds circumferentially said region. It is advantageous to position this skirt (39) just inside the periphery of the second rib (38), in order that the second rib (38) will provide protection for the edge of a label when affixed. Similarly, a bead, such as that shown as (37) in FIG. 4, can be provided to protect the lower edge of the affixed label. A third rib, corresponding to rib (18) in FIG. 1 is not required.

Figure 3:
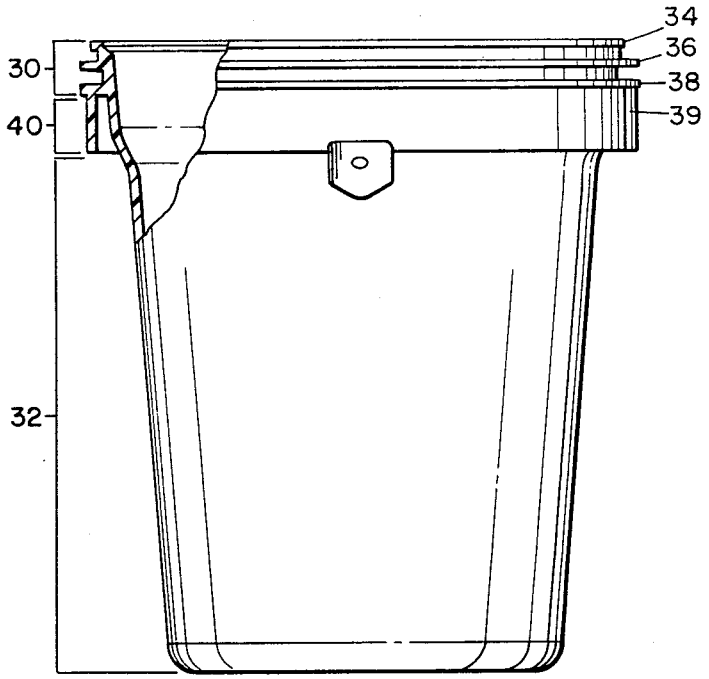
FIG. 3 shows a partially broken away view of the preform used to form the container of the present invention.
Figure 4:
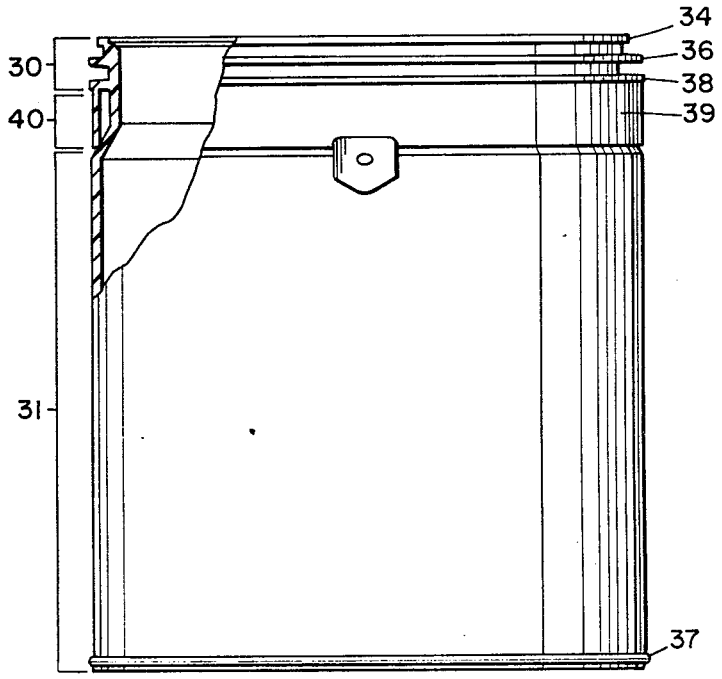
FIG. 4 shows a partially broken away view of the completed container of the present invention.

When the parison portion (32) of the preform shown in FIG. 3 is subjected to increased internal pressure during blow molding, the thermoplastic material in the parison portion (32) expands to fill the blow molding cavity, which has the dimensions of the finished container. The container which results from this procedure is shown in FIG. 4. As can be seen clearly in the partially broken away view of the container in FIG. 4, the flat exterior surface of the body portion (31) is in line with the exterior surface of the injection formed depending skirt (39) provided on the rib (38) of the mouth portion (30).

It is not required that the body portion (31) and the depending skirt (39) actually touch or be mechanically bonded, although this may be done if desired. It is only required that their flat exterior surfaces are substantially in line with each other and that any gap between them be relatively small. The combination of these flat, linear surfaces provides a labeling area substantially similar to the conventional metal containers and allows the containers of the present invention to be used on conventional filling and labeling equipment substantially interchangeably with conventional metal containers.

Figure 5A:
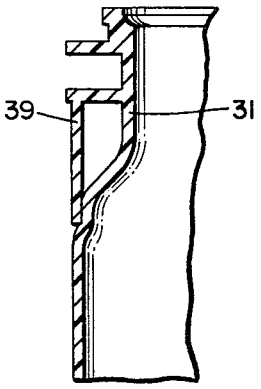
FIG. 5A shows a partial cross-sectional view of another embodiment of the container of the present invention.
Figure 5B:
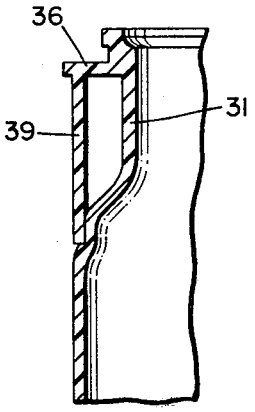
FIG. 5B shows a partial cross-sectional view of another embodiment of the container of the present invention.

When it is desired to mechanically bond the depending skirt (39) to the blown body portion (31), it is advantageous to provide for a least a small portion of the body portion (31) to be blown flat directly against the depending skirt (39). This is shown most clearly in the partial cross-section view of FIG. 5A. For the maximum label area, the depending skirt (39) may depend from rib (36), eliminating rib (38), as shown in FIG. 5B.

Figure 6:
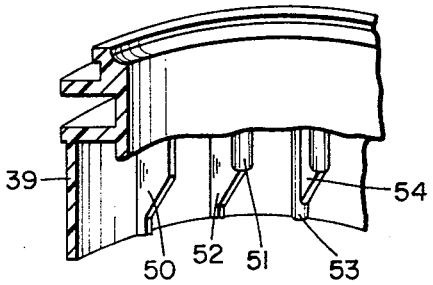
FIG. 6 shows a broken away view of the rim section of an embodiment of the container of the present invention provided with different style ribs on the interior skirt surface.

When still greater wall strength in the area of the transitional surface is desired, a plurality of integral injection molded ribs may be provided which will connect the skirt to the blown parison portion in the region of the transitional surface. Various forms of such ribs are shown for illustration in FIG. 6, although it is assumed, but not required, that only one style of rib will be present in any embodiment employing such a plurality of ribs. The simplest style rib (50) is a flat injection molded projection on the interior surface of the skirt (39) which extends inward in the radial direction a short distance. In another embodiment, the rib might have a flanged upper inner face, such as the portion (51) on rib (52), or a flanged lower inner face, such as the portion (53) on rib (54). When the parison portion (32) is blown, material would extend around the flanged portion and serve to anchor or lock the flange protuberances into the body portion (31).

One major advantage which the present invention provides over the prior art is the placement of the bale ears. Prior to the present invention integral bale ears could only be provided by injection molding in the area of the mouth portion at the top of the container where they are not compatable with conventional automatic bale machinery. Alternatively, non-integral bale ears may be provided by the mechanical, sonic or adhesive bonding of individual pieces onto the container at a position which would be compatable. Any such operation is very expensive. Further any such attachment means would not be nearly as strong as the integral molding.

Figure 7:
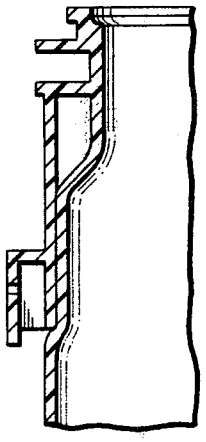
FIG. 7 shows a partial cross-sectional view of another embodiment of the container of the present invention in which the bale ears are provided at the lower periphery of the depending skirt.

It has now been found that the present invention will allow for the bale ears to be injection molded and yet provided in the more advantageous portion which is compatible with conventional automatic bale equipment. This is done by injection molding the bale ears as a feature on the lower periphery of the depending skirt, as shown in partial cross-section in FIG. 7.

What I claim and desire to protect by Letters Patent is:

1. A container comprising:

an injection molded annular mouth portion having detail of high definition, a generally cylindrical body portion blow molded from a parison injection molded integrally with the mouth portion, said body portion having a closed bottom and an inside diameter slightly larger than the inside diameter of the mouth portion, and an annular reinforcing region joining the mouth portion to the body portion and forming a transitional surface therebetween, in which the detail of high definition provided in the mouth portion includes as an outside wall over said reinforcing region an annular depending skirt which is integrally injection molded as a feature of the mouth portion.

2. The container of claim 1 further comprising as an element of the high definitional detail injection molded into the mouth portion, a plurality of ribs on the interior surface of the depending skirt extending inward a short distance in the radial direction and having the transitional surface of the finished container meet the inner periphery of said ribs.

3. The container of claim 1 further comprising as an element of the high definitional detail injection molded into the mouth portion, a plurality of ribs on the interior surface of the depending skirt extending inward a short distance in the radial direction and having the inner periphery of said ribs anchored in the thermoplastic material forming the transitional surface.

4. The container of claim 1 further comprising as an element of the high definitional detail injection molded into the mouth portion, two bale ears on the depending skirt.

5. The container of claim 4 further comprising as an element of the high definitional detail injection molded into the mouth portion, a plurality of ribs on the interior surface of the depending skirt extending inward a short distance in the radial direction and having the transitional surface of the finished container meet the inner periphery of said ribs.

6. The container of claim 4 further comprising as an element of the high definitional detail injection molded into the mouth portion a plurality of ribs on the interior surface of the depending skirt extending inward a short distance in the radial direction and having the inner periphery of said ribs anchored in the thermoplastic material forming the transitional surface.

* * * * *